US007004151B2

(12) United States Patent
Zdroik

(10) Patent No.: US 7,004,151 B2
(45) Date of Patent: Feb. 28, 2006

(54) VENTED INJECTOR CUP

(75) Inventor: Michael J. Zdroik, Metamora, MI (US)

(73) Assignee: Millennium Industries Corp., Auburn Hills, MI (US)

( * ) Notice: Subject to any disclaimer, the term of this patent is extended or adjusted under 35 U.S.C. 154(b) by 0 days.

(21) Appl. No.: 10/879,241

(22) Filed: Jun. 29, 2004

(65) Prior Publication Data

US 2005/0284449 A1 Dec. 29, 2005

(51) Int. Cl.
*F02M 37/04* (2006.01)

(52) U.S. Cl. ..... 123/516; 123/470

(58) Field of Classification Search ..... 123/470, 123/516, 468, 469, 456, 514, 447; 239/600
See application file for complete search history.

(56) References Cited

U.S. PATENT DOCUMENTS 4,341,193 A * 7/1982 Bowler ..... 123/472
4,416,238 A * 11/1983 Knapp et al. ..... 123/470
4,527,528 A * 7/1985 Finn et al. ..... 123/447
4,556,034 A * 12/1985 Anklam et al. ..... 123/470
4,601,275 A * 7/1986 Weinand ..... 123/468
5,295,467 A * 3/1994 Hafner ..... 123/456
5,819,708 A * 10/1998 Buratti et al. ..... 123/468
6,343,587 B1 * 2/2002 Kreutziger ..... 123/472
6,644,283 B1 * 11/2003 Kreutziger ..... 123/472
6,666,190 B1 * 12/2003 DiMaria et al. ..... 123/470
6,732,717 B1 5/2004 Braun et al. ..... 123/518

* cited by examiner

*Primary Examiner*—Carl S. Miller
(74) *Attorney, Agent, or Firm*—Dykema Gossett PLLC

(57) ABSTRACT

A fuel delivery system arrangement is provided for the internal combustion engine. The arrangement includes a fuel rail with an outlet and a fuel injector for metering flow of fuel from the fuel rail into the internal combustion engine. The fuel injector has a body with an inlet, which inlet has an opening. A first sealing member is provided for engaging the fuel rail outlet and sealing the fuel injector inlet opening from a portion of the fuel injector body. A second sealing member is provided which engages the fuel rail outlet and seals the injector body providing a sealed control volume between the first sealing member and the second sealing member adjacent to the fuel injector body. A vent is provided connecting a sealed control volume with an area external to the fuel injector rail and the fuel injector body.

21 Claims, 2 Drawing Sheets

VENTED INJECTOR CUP

FIELD OF THE INVENTION

The field of the present invention is that of controlling hydrocarbon permeation from a connection of a fuel injector to a fuel rail of an internal combustion engine.

BACKGROUND OF THE INVENTION

In the past three decades, there have been major technological efforts to increase the fuel efficiency of automotive vehicles. One technical trend to improve fuel efficiency has been to reduce the overall weight of the vehicle. A second trend to improve fuel efficiency has been to improve the aerodynamic design of a vehicle to lower its aerodynamic drag. Still another trend is to address the overall fuel efficiency of the engine.

Prior to 1970, the majority of production vehicles with a reciprocating piston gasoline engine had a carburetor fuel supply system in which gasoline is delivered via the engine throttle body and is therefore mixed with the incoming air. Accordingly, the amount of fuel delivered to any one cylinder is a function of the incoming air delivered to a given cylinder. Airflow into a cylinder is effected by many variables including the flow dynamics of the intake manifold and the flow dynamics of the exhaust system.

To increase fuel efficiency and to better control exhaust emissions, many vehicle manufacturers have gone to fuel injection systems, where the carburetor was replaced by a fuel injector that injected the fuel into a port or cylinder of the engine.

Vehicle emission standards have become so stringent that a vehicle designer can no longer just consider the emissions from the tailpipe. Increased scrutiny has come to hydrocarbon vapor emissions which can escape from the fuel system of the vehicle.

Most vehicles with fuel injectors have the fuel injectors connected with the fuel rail. Most fuel injectors are sealed to the fuel rail by being encircled by a sealing member which in turn seals against an outlet cup of the fuel rail. Over a process of time, sealing efficiency of the sealing member can be lost due to a change of its sealing capacity caused by an exposure to high concentration of hydrocarbons on one side of the sealing member. Accordingly after a long process of time there can be slight permeation of hydrocarbon vapor beyond the O-ring seal.

Utilization of multiple sealing members can slightly alleviate permeation problems but in due time multiple sealing members tend to realize the same problem as the permeation past one sealing member progressively permeates the next sealing members. Eventually, permeation of hydrocarbons from the connection of a fuel injector to the fuel rail occurs again.

Another attempted solution to the permeation problems has been to either solder or weld the fuel injectors to the fuel rail or to use compression type fittings utilizing metal-to-metal sealing. Both of the above noted solutions are undesirable.

From a practical standpoint, during fastening of the fuel rail to the vehicle engine it is desirable that there be a slight amount of axial play in the connection of the fuel rail with the fuel injector. Connecting the fuel rail to the fuel injector by welding or soldering and/or connecting the fuel rail to the fuel injector by compression fitting limits the opportunities of axial play of the fuel injector with the fuel rail and therefore greatly complicates assembly of the fuel rail and its connected fuel injectors with the vehicle engine.

It is desirable to provide a fuel delivery system arrangement with substantially reduced or eliminated hydrocarbon permeation caused by the connection of the fuel rail to the fuel injectors without utilizing compression fitting or welding or soldering.

SUMMARY OF THE INVENTION

To address the above noted desire the present invention is brought forth. The present invention provides an arrangement of a fuel delivery system wherein the fuel injector is sealed with the outlet of the fuel rail by primary and secondary seals. A sealed control volume between the primary and secondary seals is ventilated. The ventilation between the primary and secondary seals reduces or totally eliminates any negative effect caused by hydrocarbon saturation on a secondary seal and therefore permeation of hydrocarbon vapors to the atmosphere is virtually totally eliminated.

DETAILED DESCRIPTION OF THE INVENTION

Figure 1:
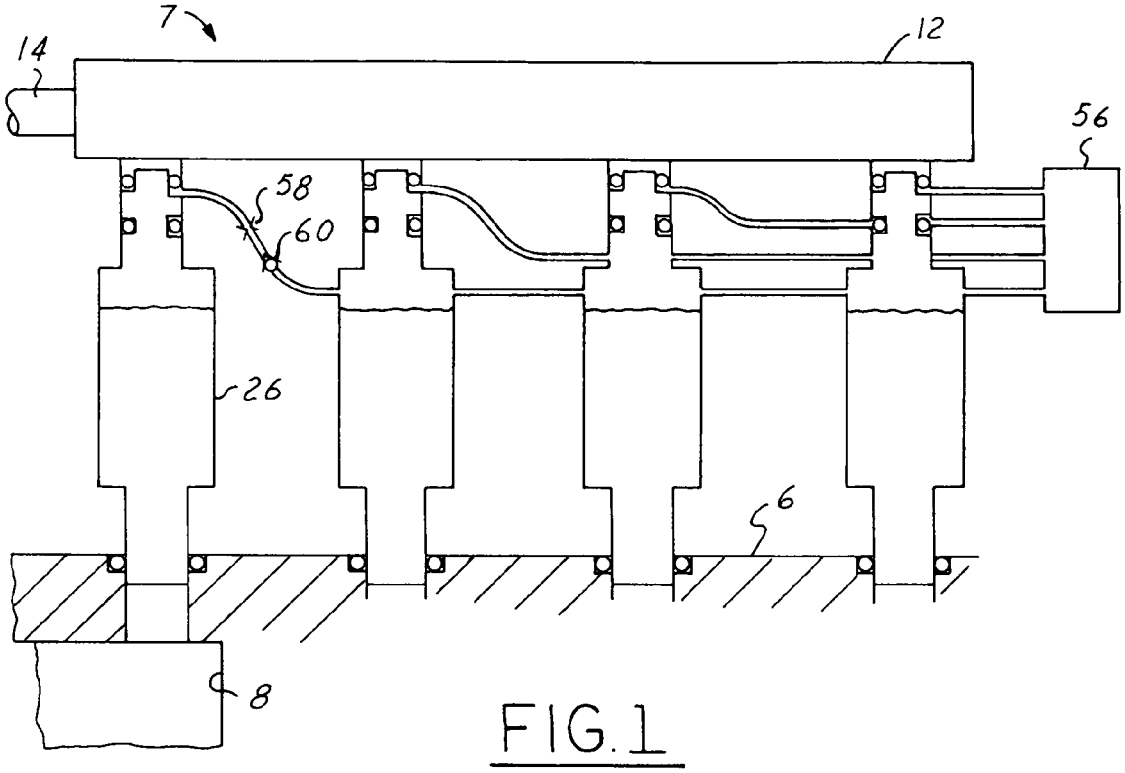
FIG. 1 is a partial sectional schematic view of an engine with a fuel delivery system arrangement according to the present invention.
Figure 2:
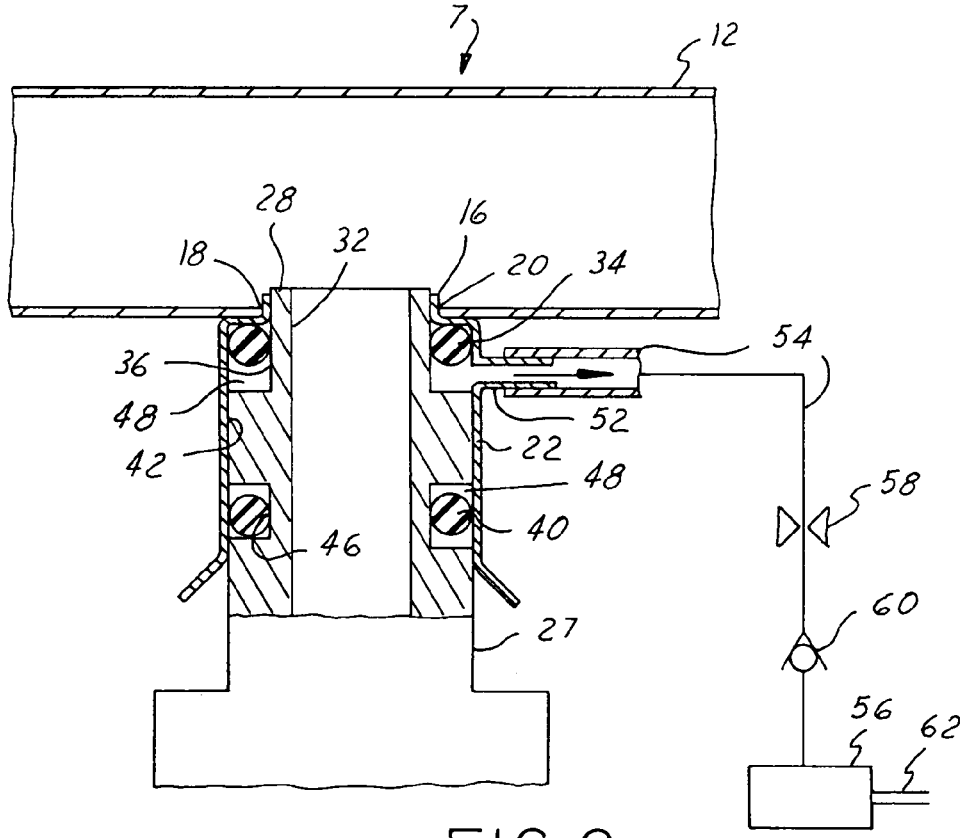
FIG. 2 is a partial sectional schematic enlargement of a portion of the fuel injector system shown in FIG. 1.

Referring to FIG. 1, an automotive engine 6 is provided. The automotive engine 6 is an internal combustion engine having a plurality of combustion chambers 8. The engine 6 is a spark-ignited, internal combustion engine. The fuel delivery system arrangement 7 includes a fuel rail 12. The fuel rail 12 has an inlet 14 and an outlet 16. The outlet 16 has an opening 18. The fuel rail opening 18 has inserted therein a neck 20 of an outlet cup 22.

To provide for metered delivery of fuel from the fuel rail 12 to the engine 6 there is provided a plurality of fuel injectors 26. The fuel injector 26 has a body 27. The fuel injector body 27 has an inlet 28, which has an inlet opening 32.

An O-ring 34 provides a first sealing member. The O-ring 34 engages with the inside of the cup 22 and seals the fuel injector opening 32 from a portion 36 of a fuel injector body which is underneath the O-ring 34. Spaced away from the O-ring 34 is a second sealing member provided by O-ring 40. O-ring 40 seals the injector body with the fuel rail 12 by contact engagement with the interior surface 42 of the cup 22. The O-ring 40 also engages an inner diameter 46 of a sealing groove provided on the injector body.

Between the O-rings 34 and 40 is a sealed control volume 48. The sealed control volume 48 is vented through a vent 52. The vent 52 is connected with a line 54 which is in turn fluidly connected with a carbon base emission control canister 56.

In operation, permeation of hydrocarbons is a function of the saturated atmosphere on one side of a sealing member and the time available for the sealing member material to reach saturation. While providing the evacuated control volume between the first O-ring 34 and the second O-ring 40 neither side of the second O-ring 40 is exposed to high concentrations of hydrocarbons for long residence times. Therefore, any external permeation past the O-ring 40 is virtually eliminated or substantially reduced.

Without the vented sealed control volume 48, hydrocarbons which over time could pass beyond the O-ring 34 would then tend to saturate the upper side of the O-ring 40 which in due time would cause the O-ring 40 to lose its operational efficiency.

The O-rings 34, 40 can be manufactured from different materials. The O-ring 34 on its upper side will be sealing a liquid. Therefore preferable materials for O-ring 34 will be standard elastomeric materials such as viton, flourosilicon and similar elastomeric materials. The O-ring 40 is mainly sealing gases. The secondary O-ring can be metallic or a polymeric material such as acetal, although standard elastomeric materials can be used.

The line 54 can optionally be fluidly connected with an orifice 58. The orifice 58 is fluidly connected with a check valve 60. The check valve 60 is connected to the emissions control canister 56. The canister is connected by a line 62 which is connected with the vacuum system of the vehicle. When the engine is off there will be a lack of vacuum in line 62 and the check valve 60 will prevent any fluid communication between the canister 56 and the vent 52. Therefore fumes within the canister 56 will not be exposed to the sealed control volume 48 and then upon time be inadvertently released into the atmosphere past O-ring 40.

Figure 3:
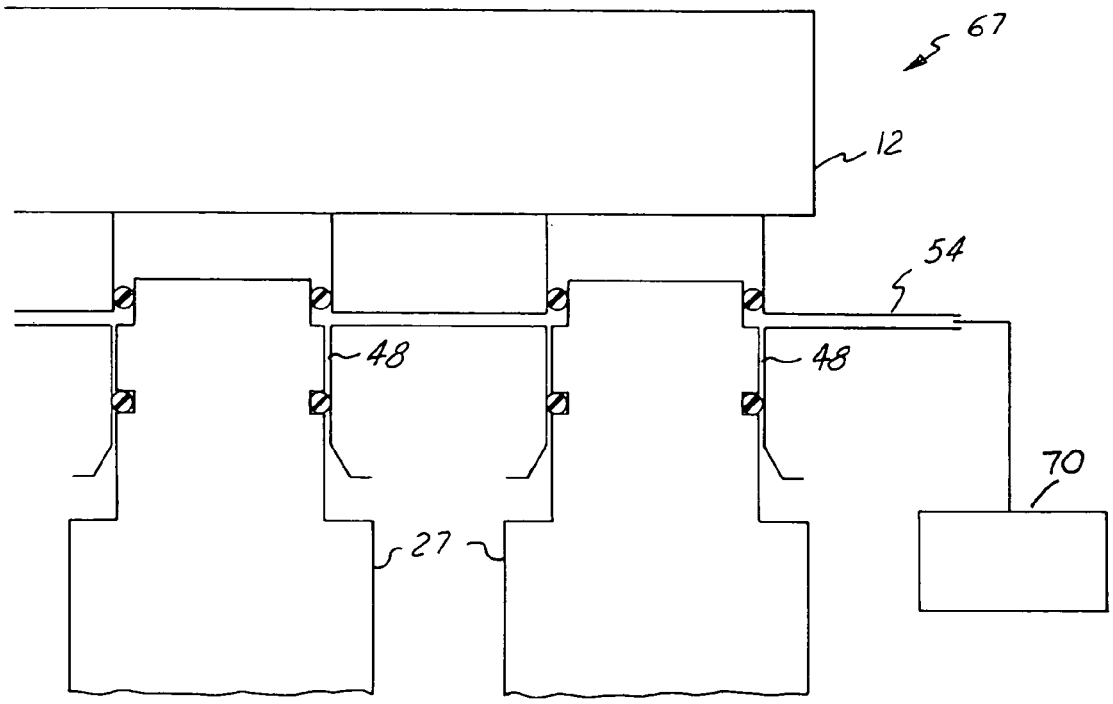
FIG. 3 is a partial sectional schematic view of an alternate preferred embodiment fuel delivery system to that shown in FIG. 1.

In an embodiment 67 shown in FIG. 3, the sealed control volumes 48 of the various fuel injectors are connected to one another in series. The vent line 54 is connected (typically via a check valve and orifice as aforedescribed) with the emissions control canister or directly with an air intake system manifold 70 of the vehicle so that any hydrocarbons permeating beyond the O-ring 34 are recirculated back into the engine.

In still another embodiment of the present invention (not shown) the sealing members need not be O-rings but can be V-type sealing members or sealing members with various other cross sectional shapes.

Although the present invention has been shown in various embodiments it will be apparent to those skilled in the art of the various changes and modifications which can be made to the present invention without departing from the spirit and scope of the invention as it is encompassed by the following claims.

What is claimed is:

1. A fuel delivery system arrangement for an internal combustion engine comprising:

a fuel rail having an outlet, said outlet having a cup;

a fuel injector for metering flow of fuel from said fuel rail to said internal combustion engine, said fuel injector having a body with an inlet, said inlet having an opening;

a first sealing member engaging said fuel rail outlet and sealing said fuel injector inlet opening from a portion of said fuel injector body;

a second sealing member engaging said fuel rail outlet and sealing said injector body within said cup of said fuel rail outlet providing a sealed control volume with said first sealing member adjacent said fuel injector body on a side of said first sealing member opposite said fuel rail outlet; and a vent connecting said sealed control volume with an area external to said fuel injector rail and said fuel injector body.

2. A fuel delivery system arrangement as described in claim 1 wherein said fuel rail is connected with a plurality of fuel injectors, each said fuel injector having associated therewith first and second sealing members and a sealed control volume and wherein said sealed control volume is vented in series.

3. A fuel delivery system arrangement as described in claim 1 wherein said first and second sealing members are manufactured from materials differing from one another.

4. A fuel delivery system arrangement as described in claim 3 wherein said first sealing member is manufactured from a material preferable for sealing liquids and said second sealing member is manufactured from a material preferable for sealing against gases.

5. A fuel delivery system arrangement as described in claim 1 wherein said first sealing member is taken from a group of elastomeric materials and said second sealing member is taken from a group of metallic and polymeric materials.

6. A spark-ignited internal combustion engine arrangement comprising:

an engine block having a combustion chamber;

a fuel rail for delivering fuel, said fuel rail having an outlet;

a fuel injector for metering flow of fuel from said fuel rail, said fuel injector being connected between said fuel rail and said combustion chamber, said fuel injector having a body within an inlet, said inlet having an opening;

a first sealing member engaging said fuel rail outlet and sealing said fuel injector inlet opening from a portion of said fuel injector body;

a second sealing member engaging said fuel rail outlet and said second sealing member sealing said injector body with said fuel rail providing a sealed control volume with said first sealing member adjacent said fuel injector body on a side of said first sealing member opposite said fuel rail outlet; and a vent for connecting said sealed control volume with an area external to said fuel rail and said fuel injector body.

7. A spark-ignited internal combustion engine arrangement comprising:

an engine block having a combustion chamber;

a fuel rail for delivering fuel, said fuel rail having a plurality of outlets;

a plurality of fuel injectors for metering flow of fuel from said fuel rail, each of said plurality of fuel injectors being connected between said fuel rail and said combustion chamber, each of said plurality of fuel injectors having a body within an inlet, said inlet having an opening;

a plurality of first sealing members, each of said plurality of first sealing members corresponding to one of said plurality of fuel rail outlets, said first sealing members engaging said corresponding fuel rail outlet and sealing each of said fuel injector inlet openings from a portion of each of said fuel injector bodies;

a plurality of second sealing members, each of said plurality of second sealing members corresponding to one of said plurality of fuel rail outlets, each of said second sealing members engaging said corresponding fuel rail outlet and each of said second sealing members sealing said corresponding injector body with said fuel rail providing a sealed control volume with said first sealing member adjacent said corresponding fuel injector body on a side of said first sealing member opposite said fuel rail outlet; and a plurality of vents for connecting each of said sealed control volumes with an area external to said fuel rail and said fuel injector body, each of said sealed control volumes being connected with one another.

8. An engine arrangement as described in claim 7 wherein said vent is connected with an emission control canister.

9. An engine arrangement as described in claim 8 wherein there is a check valve connected between said vent and said emission control canister.

10. A method of delivering fuel for a spark-ignited internal combustion engine comprising:

providing a fuel rail having an outlet;

providing a fuel injector for metered delivery of fuel from said fuel rail to said internal combustion engine, said injector having a body with an inlet, said inlet having an opening;

sealing said fuel injector inlet opening from a portion of said fuel injector body with a first sealing member;

sealing said injector body with said fuel rail to provide a sealed control volume between a second sealing member and the first sealing member adjacent to the fuel injector body on a side of said first sealing member opposite said fuel rail outlet; and venting said sealed control volume to an area external of said fuel rail and said fuel injector body.

11. A method of delivering fuel for a spark-ignited internal combustion engine comprising:

providing a fuel rail having an outlet;

providing a fuel injector for metered delivery of fuel from said fuel rail to said internal combustion engine, said injector having a body with an inlet, said inlet having an opening;

sealing said fuel injector inlet opening from a portion of said fuel injector body with a first sealing member;

sealing said injector body with said fuel rail to provide a sealed control volume between a second sealing member and the first sealing member adjacent to the fuel injector body on a side of said first sealing member opposite said fuel rail outlet; and venting said sealed control volume to an emissions control canister external of said fuel rail and said fuel injector body.

12. A method of delivering fuel as described in claim 11 further including checking off fluid communication between said sealed control volume and said emissions control canister when said internal combustion engine is off.

13. A fuel delivery system arrangement for an internal combustion engine comprising:

a fuel rail having an outlet;

a fuel injector for metering flow of fuel from said fuel rail to said internal combustion engine, said fuel injector having a body with an inlet, said inlet having an opening;

a first sealing member engaging said fuel rail outlet and sealing said fuel injector inlet opening from a portion of said fuel injector body;

a second sealing member engaging said fuel rail outlet and sealing said injector body providing a sealed control volume with said first sealing member adjacent said fuel injector body on a side of said first sealing member opposite said fuel rail outlet; and a vent connecting said sealed control volume with an area external to said fuel injector rail and said fuel injector body.

14. A fuel delivery system arrangement as described in claim 1 wherein said vent is connected with an emissions control canister.

15. A fuel delivery system arrangement as described in claim 14 wherein a check valve is connected between said vent to prevent exposure of said sealed control volume with said emissions control canister when the internal combustion engine is off.

16. A fuel delivery system arrangement as described in claim 15 further including an orifice between said emissions control canister and said vent.

17. A fuel delivery system arrangement as described in claim 14 wherein said canister is a carbon canister.

18. A fuel delivery system arrangement as described in claim 14 wherein said vent is connected with an air intake system of said internal combustion engine.

19. A fuel delivery system arrangement as described in claim 18 wherein a check valve is provided between said vent and said air intake system of said internal combustion engine.

20. A fuel delivery system arrangement as described in claim 13 wherein said first sealing member is an O-ring.

21. A fuel delivery system arrangement as described in claim 13 wherein said second sealing member is an O-ring.

* * * * *